United States Patent [19]

Cattaneo et al.

[11] 4,212,180

[45] Jul. 15, 1980

[54] DEVICE FOR CONTROLLING THE ROTATION OF THE WORKING ROLLERS IN A TUBE ROLLING MILL

[75] Inventors: Filippo Cattaneo; Rosolino Corolla, both of Milan, Italy

[73] Assignee: Innocenti Santeustacchio S.p.A., Brescia, Italy

[21] Appl. No.: 952,604

[22] Filed: Oct. 18, 1978

[30] Foreign Application Priority Data

Nov. 8, 1977 [IT] Italy ..... 29430 A/77

[51] Int. Cl.[2] ..... B21B 35/02

[52] U.S. Cl. ..... 72/249; 72/238; 72/235

[58] Field of Search ..... 72/249, 238, 237, 234, 72/235

[56] References Cited

U.S. PATENT DOCUMENTS

| | | | |
|---|---|---|---|
| 1,420,239 | 6/1922 | Brock | 72/249 X |
| 2,120,539 | 6/1938 | Barth | 72/249 |

*Primary Examiner*—Milton S. Mehr

*Attorney, Agent, or Firm*—Birch, Stewart, Kolasch & Birch

[57] ABSTRACT

A device for controlling the rotation of the working rolls in a tube rolling mill of the kind comprising a number of housings, each containing three working rollers normally in axial alignment on a single bearing structure, the rolls in each housing being keyed to corresponding shafts controlled from outside the housing and actuated by a single rotor, the device being characterized in that it comprises:

three high-speed shafts (8, 14, 21) borne outside the plurality of housings (2) in the rolling mill (1) and extending parallel to the common axis of the housings (2), a reduction gear (22, 23, 24) for each working roll (4, 5, 6) of each single housing (2), borne outside the housing and axially engageable or disengageable from the corresponding shaft (**4*a*, 5*a*, 6*a*) of the aforementioned roll (4, 5, 6), a bevel gear (22*a*, 23*a*, 24*a*) between each reduction gear (22, 23, 24) and one of the high-speed shafts (8, 14, 21), and a kinematic transmission (9, 11, 13–16, 15, 20) between the single motor (7) and each high-speed shaft (8, 14, 21**).

4 Claims, 4 Drawing Figures

DEVICE FOR CONTROLLING THE ROTATION OF THE WORKING ROLLERS IN A TUBE ROLLING MILL

BACKGROUND OF THE INVENTION

The invention relates to a device for controlling the rotation of the working rollers in a tube rolling mill, more particularly for reducing mills or sizing mills of the kind comprising a number of housings having three working rollers normally disposed in axial alignment on a single bearing structure, the rollers in each housing being keyed to corresponding shafts controlled from outside the housing and actuated by a single motor.

In the rest of the description and in the accompanying claims:

The term "rolling mill" denotes either a tube-reducing mill or a tube-sizing mill;

The terms "high-speed shaft," "high-speed gear," "high-speed bevel gear and pinion" have the usual meanings in the art, i.e. respectively denote a shaft, a kinematic gear and a pair of bevel wheels, all of which rotate at the same speed as the motor associated with the rolling-mill, and The terms "slow shaft," "slow gear," "slow bevel gear and pinion" have the usual meanings in the art, i.e. respectively denote a shaft, a kinematic gear or a pair of bevel wheels which are kinematically connected to the rolling-mill motor via a speed reduction gear.

Hitherto the rotation of the working rolls in each housing in a rolling mill of the aforementioned kind has been controlled from a single motor associated with the rolling-mill, basically by means of the following two systems:

Use of a single reduction unit for all the rolling-mill housings, the unit comprising slow gears (slow bevel gears and pinions) for each housing, i.e. for each roller, or Use of a reduction unit for each single housing, the unit being connected to the rolling-mill motor via high-speed gears and connected to the individual rolls in each housing via slow gears.

The main disadvantage of the aforementioned prior-art control systems is that a gear having a low speed and therefore a high torque is required for each working roll in each housing.

Other disadvantages are that each housing bearing has considerable size and weight, and the distance between the axes of adjacent housings is difficult to reduce to the optimum technological value. Another serious disadvantage is the complexity and difficulty of the maintenance operations periodically required on the housing bearing, or the adjustment of the bearings themselves.

SUMMARY OF THE INVENTION

The invention is based on the problem of designing and constructing a novel device for controlling the rotation of the working rollers of each housing, driven by a single motor associated with the entire rolling mill and having structural and functional features which completely and simultaneously obviate the aforementioned disadvantages.

To this end, according to the invention, the device comprises:

three high-speed shafts borne outside the plurality of housings in the rolling mill and extending parallel to the common axis of the housings, a reduction gear for each working roll of each single housing, borne outside the housing and axially engageable or disengageable from the corresponding shaft of the aforementioned roll, a bevel gear between each reduction gear and one of the high-speed shafts, and a kinematic transmission between the single motor and each high-speed shaft.

Advantageously, in a preferred embodiment of the invention, the reduction gears used for all the working rolls of all the housings are identical.

According to a third feature, the reduction gear for each working roll is an epicyclic gear connected to the corresponding high-speed shaft via a preliminary cylindrical gear.

According to another structural feature of the device according to the invention, one of the high-speed shafts is directly actuated by the single motor whereas the other high-speed shafts are connected to the motor via corresponding bevel gears and Cardan transmission shafts, the connections being made at one end of the rolling mill.

The main advantages of the invention can be summarized as follows:

elimination of slow bevel gears and pinions, i.e. of high torque, a considerable reduction in the distance between the axes of adjacent housings, the possibility of using standard, easily-replaceable components, and a considerable reduction in the size and weight of the driving mechanism.

BRIEF DESCRIPTION OF THE DRAWINGS

Other features and advantages of the invention will be clear from the following detailed description of an embodiment of a rolling mill fitted with a device according to the invention, with reference to the accompanying drawings in which.

DETAILED DESCRIPTION OF THE ILLUSTRATED EMBODIMENTS

Figure 1:
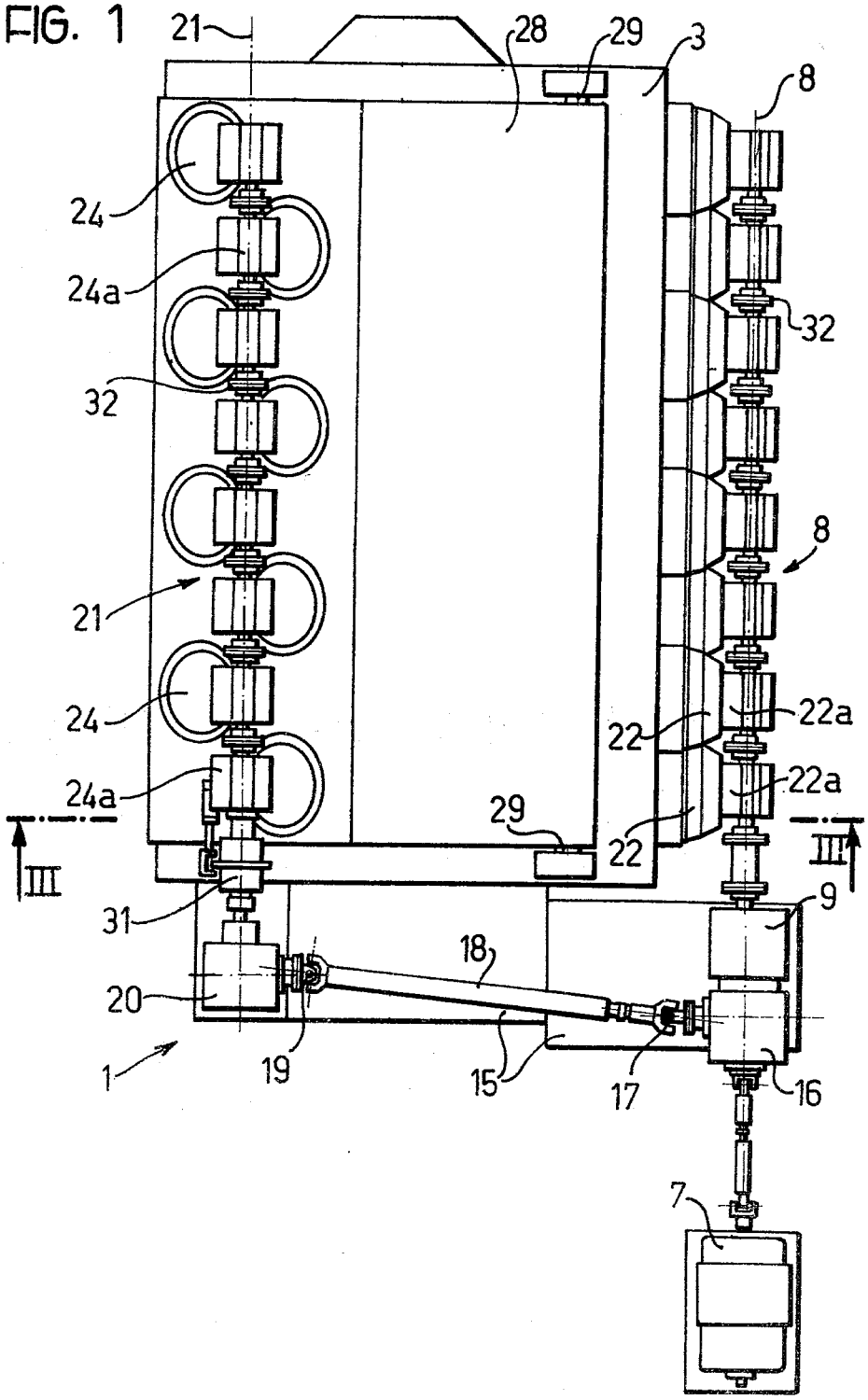
FIG. 1 is a diagrammatic plan view of a rolling mill according to the invention.
Figure 2:
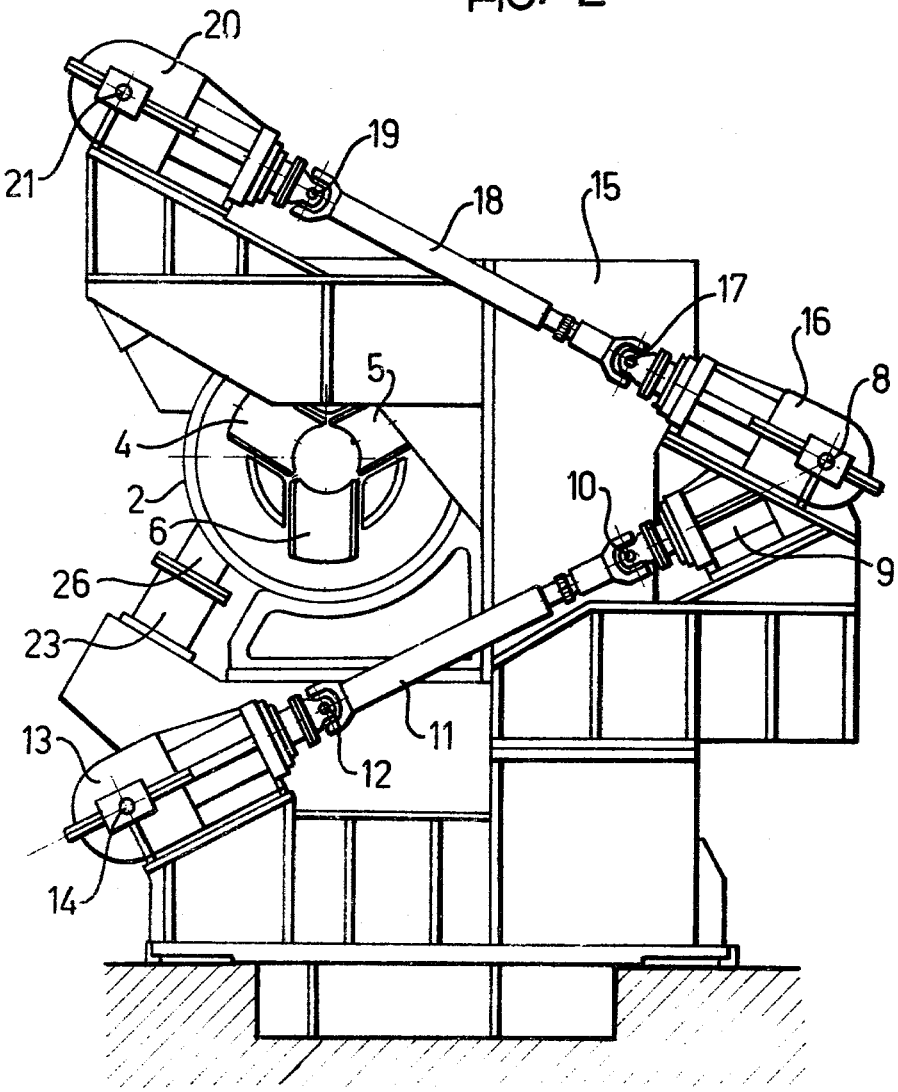
FIG. 2 shows the rolling mill in FIG. 1, in front view.

The drawings show a rolling mill 1 (a sizing mill in the present case) comprising a number of housings 2 normally disposed in axial alignment on a bearing structure 3. Each housing 2 has three working rolls 4, 5, 6 keyed on respective shafts (not shown) and rotating on corresponding axes *4a, 5a, 6a* indicated by broken lines.

The rolling mill 1 has a single motor 7 which directly controls the rotation of a horizontal high-speed shaft 8 borne by structure 3 parallel to the axis of housings 2 and on the side remote from them.

A first bevel gear diagrammatically indicated by 9 is mounted on shaft 8 in front of rolling-mill 1 and comprises a pair of bevel wheels (conventional and therefore not shown) one wheel being coaxially keyed to shaft 8. The other bevel wheel in gear 9 is connected by a universal joint 10 to one end of a transmission shaft 11. The other end of shaft 11 is connected via a universal joint 12 to one bevel wheel (not shown) of a bevel gear indicated at 13.

Gear 13 is mounted at the free end of a second high-speed shaft 14 parallel to shaft 8 and extending at the side of housing 2 in a lateral position below the housings.

Bevel gear 9, transmission shaft 11, the associated universal joints 10, 12 and the bevel gear 13 are borne by a frame 15 secured to structure 3 at a predetermined distance from the first or last housing.

A bevel gear indicated at 16 is mounted on shaft 8 and borne by frame 15 and, as before, comprises a pair of bevel wheels (conventional and therefore not shown). One of these wheels is coaxially keyed to shaft 8 whereas the other is connected via a universal joint 17 to one end of a transmission shaft 18, the other end of which is connected via a universal joint 19 to one of the bevel wheels (not shown) comprising a bevel gear 20.

Gear 20 is mounted on the free end of a third high-speed shaft 21 parallel to shafts 8, 14 and extending alongside housings 2 above the housings.

Figure 3:
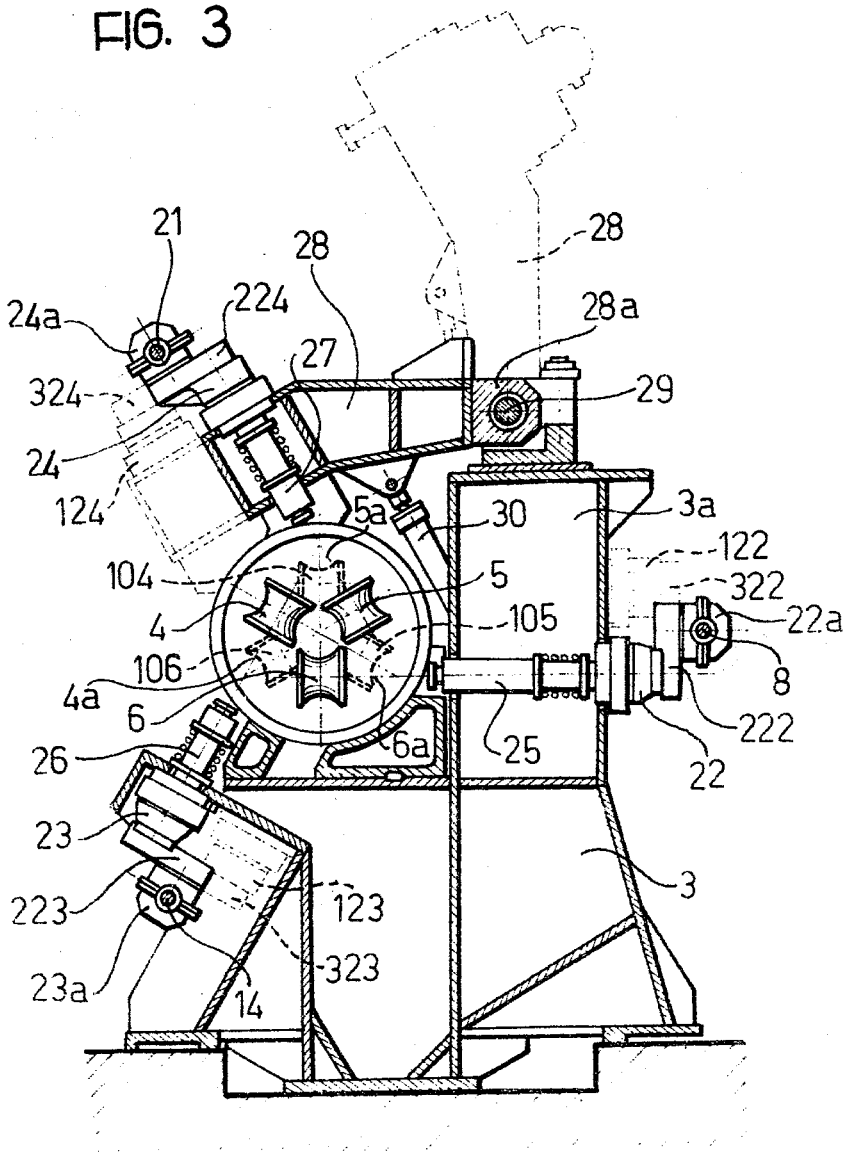
FIG. 3 is a section along line III—III in FIG. 1.

With reference to FIG. 3, the following description relates to only one out of the plurality of housings 2, but the entire description of this housing relates to the remaining housings in the rolling mill.

References 22, 23, 24 schematically denote three identical reduction gears. Gear 22, which is borne by the column portion 3*a* of the bearing structure 3, is kinematically connected to shaft 8 via a bevel gear indicated at 22*a*, comprising a pair of toothed bevel wheels (conventional and therefore not shown), one wheel being coaxially keyed to shaft 8 and the other engaging the inlet of reduction gear 22. Gear 22 controls the rotation of the working roll 6 via a kinematic connection which in a conventional manner comprises a transmission shaft 25 which automatically engages shaft 6*a* of roll 6.

Reduction gear 23 is connected to shaft 14 via a bevel gear 23*a* which likewise comprises a pair of toothed bevel wheels (not shown), one being coaxially keyed to shaft 14 and the other kinematically connected to the inlet of reduction gear 23. Gear 23 controls the rotation of roll 4 via a kinematic transmission which in conventional manner comprises a transmission shaft 26 which can engage or be disengaged from the shaft 4*a* of roll 4.

In the same manner as described in connection with reduction gears 22 and 23, gear 24 is connected to shaft 21 via a bevel gear 24*a* and controls the rotation of the working roll 5, to which it is kinematically connected via a transmission shaft 27 which can engage or be disengaged from shaft 5*a* of roll 5.

Shafts 25, 26 when disengaged, can be retracted into a position where they do not interfere with the movement of housing 2 when a housing has to be replaced.

The plurality of upper lateral reduction gears 24 used in the rolling mill according to the invention are borne by a cross member 28 having one end 28*a* pivoted at a horizontal pivot 29 borne by structure 3 parallel to the common axis of housings 2.

Cross member 28 can be angularly moved or tilted around the longitudinal axis of pivot 29 by actuating one or more hydraulic cylinders 30, so as to change the housings 2. Accordingly, a disengaging means is disposed between shaft 21 and the corresponding bevel gear 20. Means 31 (FIG. 1) can be of a conventional kind, i.e. hydraulic, electromechanical, etc.

It is known that, in a sizing or reducing rolling mill fitted with a number of three-roll housings 2, the rolls in each housing are angularly offset by 60° relative to the rolls in the adjacent housings. In FIG. 3, broken lines indicate the rolls 104, 105, 106 in the housing following the previously-described housing 2, and the associated reduction gears 122, 123 and 124. According to a preferred embodiment, the sets of three rollers 4, 5, 6 and the sets of three rollers 104, 105, 106 are controlled and rotated, using the three shafts 8, 14, 21 described hereinbefore, by means of reduction gears 22, 23, 24 and 122, 123, 124 respectively, the gears being epicyclic and connected to shafts 8, 14, 21 via preliminary conventional cylindrical gears indicated at 222, 223, 224 and 322, 323, 324.

Figure 4:
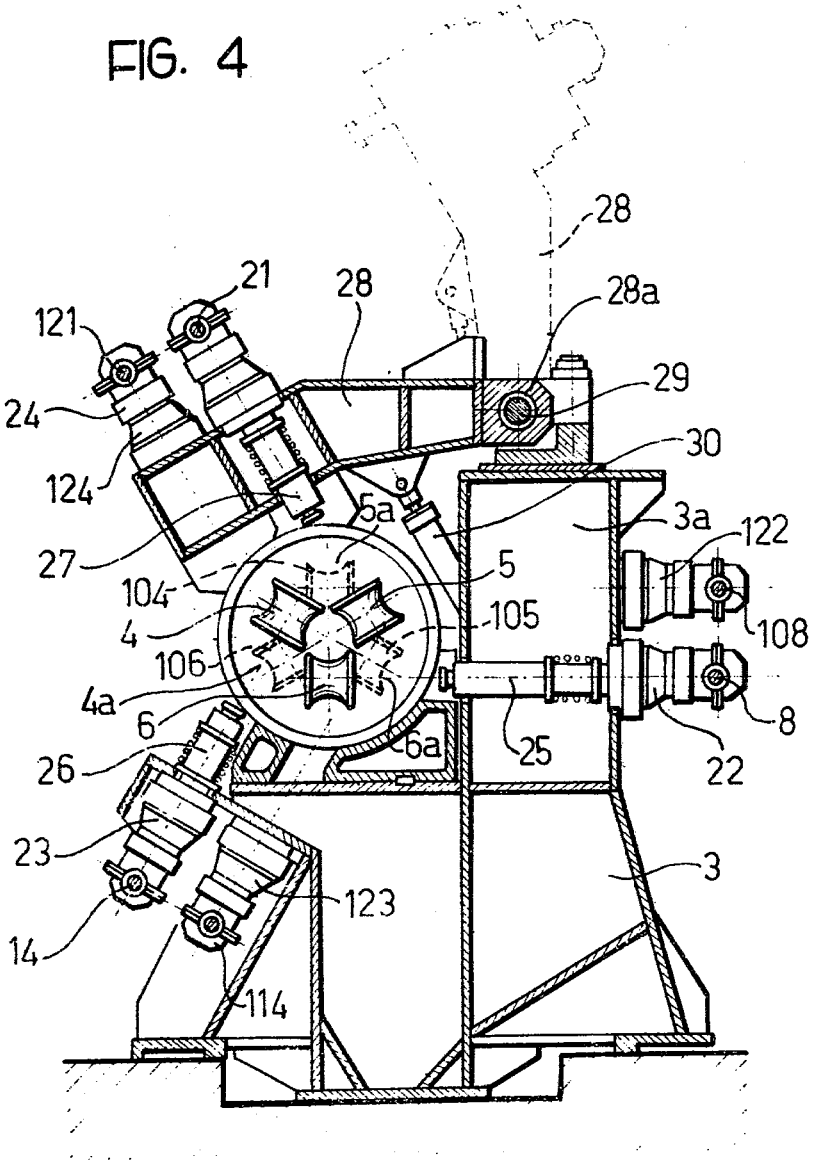
FIG. 4 is a variant of FIG. 3.

Of course (FIG. 4) it may be advantageous, in order to meet special operating requirements of the rolling mill, to control the sets of three rolls, 4, 5, 6 of the first, third and fifth housing, etc., via reduction gears connected to shafts 8, 14, 21 and to control the sets of three rolls 104, 105, 106 of the second, fourth, sixth, etc., housing via reduction gears 122, 123, 124 connected to corresponding high-speed shafts 108, 114, 121 borne parallel to the previously-mentioned shafts and, like them, kinematically connected to motor 7. In that case, the rolling mill will be equipped with three pairs of high-speed rollers 8, 108; 14, 114 and 21, 121 in pairs and there will no longer be any need for preliminary cylindrical gears between the reduction gears and the corresponding high-speed shafts when the reduction gears are epicyclic.

For economy and ease of maintenance, all the reduction gears used in the rolling mill according to the invention are identical; the required differences in speed between successive housings are obtained by adjusting the transmission ratios in the bevel gears 22*a*, 23*a*, 24*a* or in the preliminary cylindrical gears.

In practice, with reference to FIG. 1, the high-speed shafts 8, 14, 21 are made up of the pluralities of shafts of the pairs of bevel wheels making up the bevel gears described hereinbefore, and interconnected by joints 32.

We claim:

1. A device for controlling the rotation of working rolls in a tube rolling mill of the kind comprising a number of housings, each containing three working rollers normally in axial alignment on a single bearing structure, the rolls in each housing being keyed to corresponding shafts controlled from outside the housing and actuated by a single rotor, the device being characterised in that it comprises:

three high-speed shafts (8, 14, 21) borne outside a plurality of housings (2) in the rolling mill (1) and extending parallel to the common axis of the housings (2), a reduction gear (22, 23, 24) for each working roll (4, 5, 6) of each single housing (2), borne outside the housing and axially engageable or disengageable from the corresponding shaft (4*a*, 5*a*, 6*a*) of the aforementioned roll (4, 5, 6), a bevel gear (22*a*, 23*a*, 24*a*) between each reduction gear (22, 23, 24) and one of the high-speed shafts (8, 14, 21), and a kinematic transmission (9, 11, 13–16, 15, 20) between the single motor (7) and each high-speed shaft (8, 14, 21).

2. A device according to claim 1, characterised in that the reduction gears (22, 23, 24) used for all the working rolls (4, 5, 6) of all the housings (2) are identical.

3. A device according to claims 1 or 2, characterised in that the reduction gear (22, 23, 24) for each working roll (4, 5, 6) is an epicyclic gear connected to the corresponding high-speed shaft (8, 14, 21) via a preliminary cylindrical gear (222, 223, 224).

4. A device according to claim 3, characterised in that one of the high-speed shafts (8) is directly actuated by the single motor (7) whereas the other high-speed shafts (14, 21) are connected to the motor (7) via corresponding bevel gears (9, 13, 16, 20) and Cardan transmission shafts (10, 11–17, 18, 19), the connections being made at one end of the rolling mill (1).

* * * * *